US005237764A

United States Patent [19]

Gray

[11] Patent Number: 5,237,764

[45] Date of Patent: Aug. 24, 1993

[54] SOLAR DRIVEN NOVELTY DEVICE

[76] Inventor: Jay C. Gray, 314 Housatonic Ave., Stratford, Conn. 06497

[21] Appl. No.: 919,294

[22] Filed: Jul. 24, 1992

[51] Int. Cl.[5] ..... G09F 19/02

[52] U.S. Cl. ..... 40/473; 40/597; 248/206.4; 136/291

[58] Field of Search ..... 40/473, 474, 430, 435, 40/486, 597; 248/206.3, 206.4; 136/291

[56] References Cited

U.S. PATENT DOCUMENTS

| | | | |
|---|---|---|---|
| 954,752 | 4/1910 | Marks | 248/206.4 |
| 1,547,864 | 7/1925 | Etcheto | 40/474 |
| 2,641,856 | 6/1953 | Gabrielsen | 40/474 |
| 2,817,913 | 12/1955 | Meyer | 40/473 |
| 2,919,353 | 2/1956 | Paradise . | |
| 3,289,338 | 12/1966 | Stephens | 248/206.4 |
| 3,321,856 | 5/1967 | Huber | 40/473 |
| 3,325,930 | 12/1967 | Braeutigam . | |
| 3,381,399 | 5/1968 | Drueck | 40/473 |
| 3,541,322 | 11/1970 | Bennett | 248/206.4 |
| 4,182,077 | 1/1980 | Wagner et al. . | |
| 4,227,327 | 10/1980 | Thompson . | |
| 4,235,041 | 11/1980 | Sweet | 248/206.4 |
| 4,333,262 | 6/1982 | Kimura . | |
| 4,369,498 | 1/1983 | Schulte . | |
| 4,486,820 | 12/1984 | Baba et al. . | |
| 4,539,516 | 9/1985 | Thompson . | |
| 4,686,441 | 8/1987 | Petterson . | |
| 4,764,850 | 8/1988 | Albanese . | |
| 4,873,790 | 10/1989 | Laterza . | |

FOREIGN PATENT DOCUMENTS

| | | | |
|---|---|---|---|
| 23230 | 6/1935 | Austria | 40/474 |
| 597173 | 4/1975 | France | 40/486 |

*Primary Examiner*—Peter M. Cuomo
*Assistant Examiner*—Flemming Saether
*Attorney, Agent, or Firm*—St. Onge. Steward, Johnston & Reens

[57] ABSTRACT

The present invention comprises a solar driven novelty device including a frame having a first side and a second side; a solar panel attached to the frame and in an adjustable relationship thereto; a rotatable disk disposed on the frame; a motor in operative connection with the solar panel and also in operative connection with the disk, wherein the motor causes the disk to rotate in response to electricity generated by the solar panel and transmitted to the motor; and suction cups for attaching the frame to the surface, the suction cups being adjustable to permit either the first side of the frame or the second side of the frame to be adjacent to the surface.

20 Claims, 2 Drawing Sheets

SOLAR DRIVEN NOVELTY DEVICE

FIELD OF THE INVENTION

The present invention relates to a solar driven novelty device which is capable of being mounted in a variety of ways while still ensuring receipt of incident light irrespective of the orientation of mounting.

BACKGROUND OF THE INVENTION

With the development of solar energy, and the ability to form miniature solar panels capable of producing sufficient electricity to drive a small motor, portable solar driven devices have become highly desired by consumers. These devices are oriented so as to receive incident light on the solar panel and, with the electricity generated thereby, operate a mechanical device such as a motor which rotates a disk, the disk having a graphic design on it.

Because of the nature of commercially available solar driven devices, it is required that they be mounted in such an orientation to permit incident light to be received by the solar panel. However, this creates a great loss in flexibility in terms of where the consumer can mount the device. For instance, it may be desirable to mount a solar driven device on the outside of the window of a home or office such that the device can be viewed from inside the home. Alternatively, it may be desirable to mount the same device inside the window and have it viewed from inside the home. It may likewise be desirable to mount the device on the window of an automobile inside the cabin of the automobile to prevent loss of the device while driving and have the device viewed from outside the automobile. Current solar driven devices do not have the flexibility to permit the consumer to use either method of mounting with a single device.

It would be desirable to provide a solar driven novelty device which is capable of being mounted in a variety of manners while still permitting receipt of incident light on its solar panel.

SUMMARY OF THE INVENTION

It is an object of the invention to provide a solar driven novelty device which is visually interesting and is capable of flexibility in where and how it is mounted. It is also an object of the invention to provide such a device that is capable of being mounted either on the outside surface of a window or on the inside surface of a window while maintaining receipt of incident light on the solar panel.

These objects and others as set forth herein are provided by a solar driven novelty device in accordance with the invention, generally comprising a frame which has a front side and a rear side, a solar panel attached to the frame in a pivotable relationship thereto such that the solar panel can be pivoted in relation to the frame to allow it to receive incident light irrespective of the orientation of the frame; a rotatable disk disposed on the frame at its front side; a motor disposed on the frame at its rear side and in operative connection with the solar panel and also in operative connection with the rotatable disk; and a means for attaching the frame to a glass surface, the attachment means being adjustable to permit either the front side or the rear side of the frame to be adjacent to the glass surface to which the frame is attached.

The attachment means preferably used comprise at least one and preferably four rods which extend out from the frame on both the front and rear sides thereof. Mechanical supports other than rods can be used to space the frame from the window. Suction cups can then be removably disposed on the extending rods, on the ends either extending from the front side or the rear side to permit attachment so that either the front side or the rear side is adjacent the glass surface. For instance, if it is desired that the device be attached to the outside of the window, with the rotatable disk facing inside, the suction cups are disposed on the rods extending from the front side of the frame, which is the side on which the rotatable disk is disposed. In this way, attachment of the suction cups to the window causes the rotatable disk to be adjacent the window, which permits viewing of the rotatable disk from inside the window. Likewise, when it is desired to attach the device of this invention on the inside of a window (for instance when the device is being disposed on an automobile window), the suction cups are disposed on the extending portions of the rods which extend from the front side of the frame, the same side on which the rotatable disk is disposed. In this way, the rotatable disk faces toward the window and to the exterior of the automobile for viewing thereof.

Because the solar panel is attached to the frame in a pivotable relationship thereto, the solar panel can be pivoted to face either the front side or the rear side of the frame (or somewhere in between) depending on which side faces the source of incident light (i.e., the sun). This permits receipt of incident light by the solar panel regardless of the orientation of the frame with respect to the glass surface to which it is attached. In this way, the user can mount the solar driven novelty device of this invention in any of various orientations while still permitting viewing of the rotatable disk and receipt of incident light by the solar panel for operation of the device.

When used in an automobile, the amount of incident light changes as the automobile changes its angle with respect to the sun and as the automobile travels through shade. The amount of electricity supplied to the motor varies and the disk speed varies, which creates an attention getting pattern of movement. If the disk includes advertising, the variable speed of the disk would assist in getting attention.

Other objects, aspects, and features of the present invention in addition to those mentioned above, will be pointed out in or will be understood from the following detailed description, provided in conjunction with the accompanying drawings.

DETAILED DESCRIPTION OF THE PREFERRED EMBODIMENT

Figure 1:
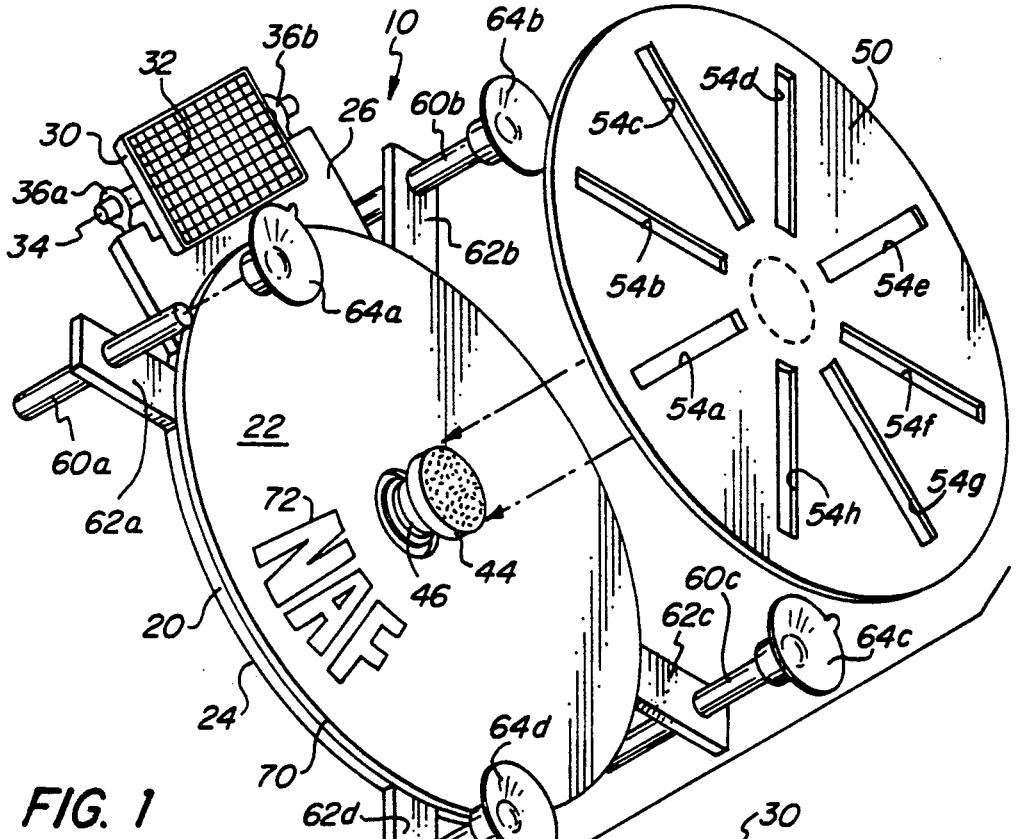
FIG. 1 is a partially exploded perspective view of an embodiment of a solar driven novelty device in accordance with the invention.
Figure 2:
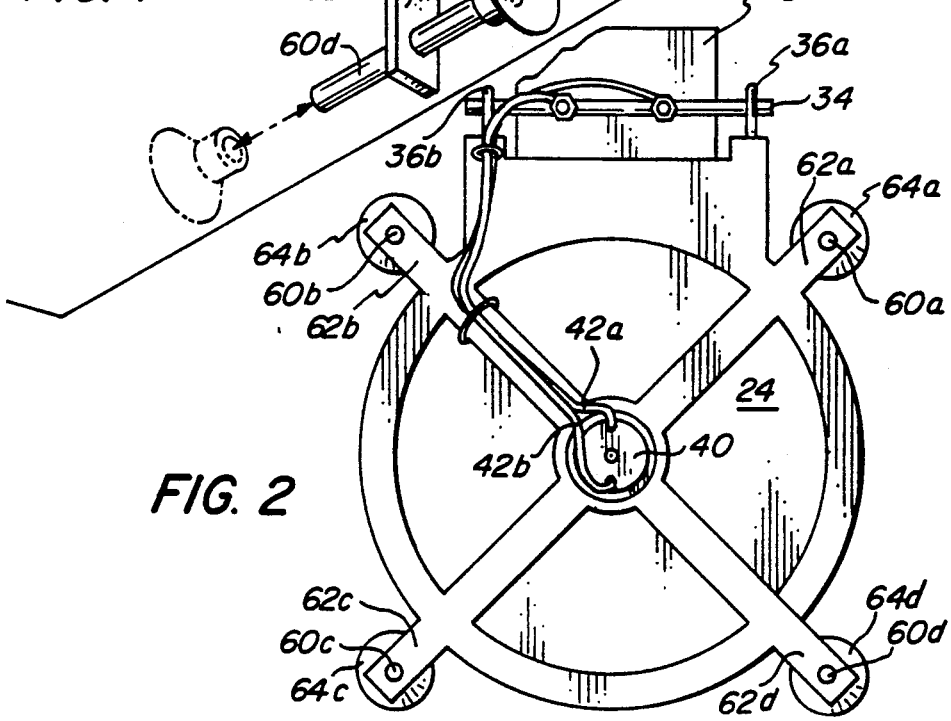
FIG. 2 is an elevated rear side plan view of the solar driven novelty device of FIG. 1, with its solar panel pivoted such that its receptive face is facing the front side of said device.

Referring now to FIGS. 1–4, where like elements are identified by like numbers in the drawings, a solar driven novelty device is shown generally at 10, which is capable of being mounted in a variety of orientations without interfering with operation.

Device 10 generally comprises a frame 20 which has a first o front side 22 and a second or rear side 24 (it will be understood that that terms "front", "rear", "first", and "second" as used herein are used for the sake of convenience only and are not meant to imply order of importance). Frame 20 can be formed of plastic, metal, hardened rubber, or any other material of suitable structural strength and stability. Advantageously, frame 20 is made of a plastic.

Extending from frame 20 is a solar panel 30 which comprises a receiving face 32 capable of receiving incident light and generating electricity therefrom. Solar panel 30 is mounted on frame 20 so as to be in a pivotable relationship thereto. That is, solar panel 30 can pivot so as to face either first side 22 or second side 24 of frame 20, or indeed, to be oriented so as to be oriented in any angle with respect to either first side 22 or second side 24 of frame 20. In order to best accomplish this as illustrated in FIG. 1, solar panel 30 is fixed mounted on bar 34 which is disposed through eye hooks 36*a* and 36*b*, each of which are fixedly attached to frame 20 via extension 26. In this way, solar panel 30 can pivot with respect to frame 20 by turning bar 34 in eye hooks 36*a* and 36*b*. It should be understood that other mechanisms for adjusting the solar panel with respect to the frame can be used, such as ball in socket mechanisms and the like.

Figure 4:
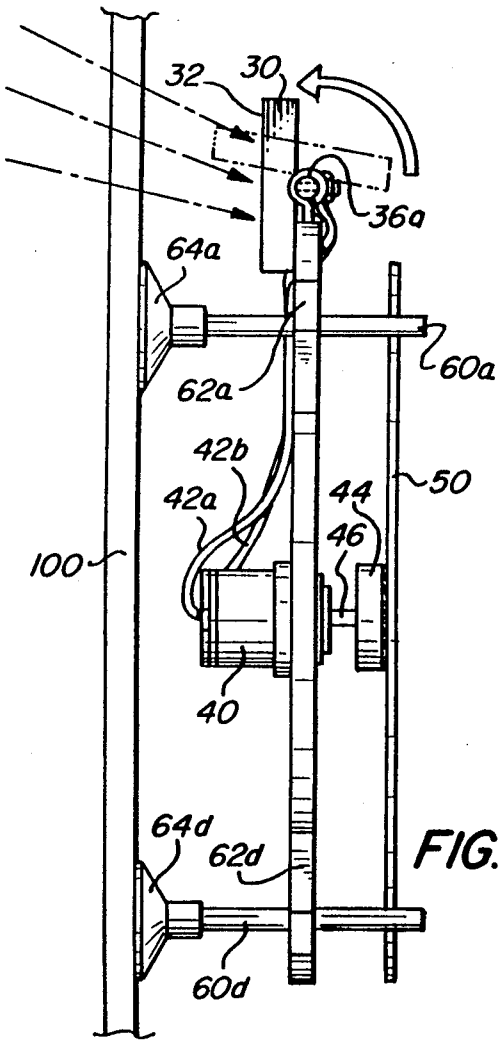
FIG. 4 is a side plan view of the solar driven novelty device of FIG. 1 which is mounted inside a window such that the rotatable disk can be viewed from inside the window and the solar panel pivoted such that its receiving face receives incident light from outside the window.
Figure 3:
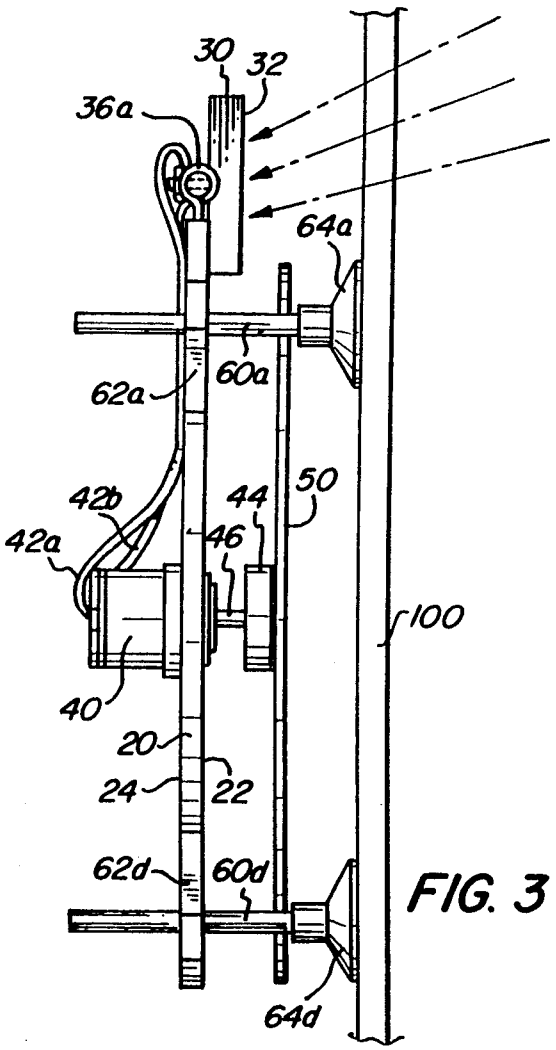
FIG. 3 is a side plan view of the solar driven novelty device of FIG. 1 which is mounted inside of the window, such that its rotatable disk can be viewed from outside the window and the solar panel pivoted such that its receiving face receives incident light from outside the window.

Referring now to FIGS. 3 and 4, a motor 40 is disposed in a central area of frame 20 on its second side 24 and which is in electrical connection with solar panel 30 via wires 42*a* and 42*b* such that electricity generated by solar panel 30 is transmitted to motor 40 and can be used to operate motor 40. Frame 20 also has attached thereto on its first side 22 a rotatable disk 50 which is attached (such as by adhesive or other like means) to an attachment disk 44 which extends via an axle 46 to motor 40 such that operation of motor 40 causes axle 46 and attachment disk 44 to rotate, which thereby causes rotatable disk 50 to rotate. In this manner, receipt of incident light on solar panel 30 causes disk 50 to rotate through the operation of motor 40.

In a unique and advantageous aspect of this invention, frame 20 can be mounted to a glass surface 100 such that either first side 22 of frame 20 at which rotatable disk 50 is mounted or second side 24 of frame 20 at which motor 30 is mounted can face the glass surface 100. In this manner, device 10 can be mounted either outside a window with rotatable disk 50 facing in and towards glass surface 100, and receiving face 32 of solar panel 30 pivoted outwardly away from glass surface 100 to receive incident light; or inside a window with rotatable disk 50 facing in and away from glass surface 100, and receiving face 32 of solar panel 30 pivoted towards glass surface 100 to receive incident light.

Frame 20 is adjustably mounted to glass surface 100 via extension rods 60*a*, 60*b*, 60*c*, and 60*d*, each of which are attached to frame 20 by extending arms 62*a*, 62*b*, 62*c*, and 62*d*. Rods 60*a*, 60*b*, 60*c*, and 60*d* extend from frame 20 on both first side 22 and second side 24. The attachment means used to attach frame 20 to glass surface 100 further comprises suction cups 64*a*, 64*b*, 64*c*, and 64*d*, which can be disposed on either end of each of rods 60*a*, 60*b*, 60*c*, and 60*d*.

Referring to FIG. 3, suction cups 64*a*, 64*b*, 64*c*, and 64*d* are disposed on the ends of rods 60*a*, 60*b*, 60*c*, and 60*d* which extend from first side 22 if it is first side 22 which is desired to be adjacent glass surface 20.

Referring to FIG. 4, if it is second side 24 of frame 20 which is desired to be adjacent glass surface 100, then suction cups 64*a*, 64*b*, 64*c*, and 64*d* are disposed on the ends of rods 60*a*, 60*b*, 60*c*, and 60*d* which extend from second side 24. In this way, frame 20 can be attached to glass surface 100 such that either first side 22 or second side 24 faces glass surface 100.

Rods 60*a*, 60*b*, 60*c*, and 60*d* also function to space disk 50 away from glass surface 100, as shown in FIG. 3, to prevent interference by glass surface 100 with the rotation of disk 50. In addition, as shown in FIG. 4, rods 60*a*, 60*b*, 60*c*, and 60*d* function to space motor 40 away from glass surface 100. The spacing function of rods 60*a*, 60*b*, 60*c*, and 60*d* also provides sufficient space for solar panel 30 to pivot such that receiving face 32 is positioned to receive incident light, even when device 10 is mounted on glass surface 100 when solar panel 30 is pivoted.

Rotatable disk 50 can comprise indicia such as lettering or other indicating means, which can be viewed as rotatable disk 50 is rotating. In this case, it is desired that the speed of rotation of rotatable disk 50 be limited to permit viewing of the indicia. Motor 50, therefore, must contain a gear which reduces the speed of rotation of rotatable disk 50 such that indicia contained thereon can be viewed. In an alternative and advantageous aspect of the invention, solar driven novelty device 10 further comprises a stationary disk 70 disposed on first side 22 of frame 20 such that it is in a spaced relationship between frame 20 and rotatable disk 50. Rotatable disk 50 can then be provided with slits 54*a*, 54*b*, 54*c*, 54*d*, 54*e*, 54*f*, 54*g*, and 54*h* which permit viewing of stationary disk 70 while rotatable disk 50 is rotating. In this case, there is no need for a gear to reduce the speed of rotation of rotatable disk 50 since faster rotation leads to easier viewing of stationary disk 7 through slits 54*a*–54*h* of rotatable disk 50.

It should be understood that the design of the rotatable disk 50 or stationary disk 70 can be varied to permit numerous effects of color, movement, and optical illusions. The disks can include design features and advertising.

In order to provide pleasant or interesting viewing, rotatable disk 50 and stationary disk 70 should be of different colors in order to achieve a desired level of contrast. In addition, stationary disk 70 may contain indicia 72 such as lettering or other means which can be seen while rotatable disk 50 is rotating for advertising or other purposes.

Device 10 can be used, therefore, to provide an interesting and attractive means for conveying a message via the indicia on either rotatable disk 50 or stationary disk 70, and can function as an advertising means or means to convey any desired message in an interesting fashion. As noted, device 10 can be mounted outside a window, such as a house window, with rotatable disk 50 and stationary disk 70 facing in the window, and solar panel 30 pivoted so as to receive incident light from outside the window; or device 10 can be mounted inside a window, such as an automobile window, with rotatable disk 50 and stationary disk 70 facing inside and solar panel 30 pivoted to face outside the window and receive incident light therefrom.

The present invention, therefore, provides a new and useful solar driven novelty device which is capable of being mounted in a flexible manner yet still receive incident light in order to permit operation of device 10.

To summarize, device 10 has the flexibility of being mounted in at least four ways: (1) inside the window, disk 50 facing out and solar panel 30 facing out; (2) inside the window, disk 50 facing in, solar panel 30 facing out; (3) outside the window, disk 50 facing out, solar panel 30 facing out; and (4) outside the window, disk 50 facing out, solar panel 30 facing out. In addition, device 10 can be attached to any surface so long as there is a light source for solar panel 30.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A solar driven novelty device for mounting to a surface comprising:

a) a frame having a first side and a second side;

b) a solar panel attached to said frame and in an adjustable relationship thereto such that said solar panel can be adjusted in relation to said frame to receive incident light irrespective of the orientation of said frame;

c) a rotatable disk disposed on said frame;

d) a motor in operative connection with said solar panel and also in operative connection with said disk, wherein said motor causes said disk to rotate in response to electricity generated by said solar panel and transmitted to said motor; and e) means for attaching said frame to the surface, said means being adjustable to permit either said first side of said frame or said second side of said frame to be adjacent to the surface to which said frame is attached, wherein said attachment means comprises at least one rod, a portion of which extends out from said first side and said second side of said frame such that sufficient space is provided for pivoting of said solar panel, rotation of said rotatable disk and operation of said motor.

2. The solar driven novelty device of claim 1, wherein said attachment means further comprises at least one suction cup which is removably disposed on either of said extending portions of said rods.

3. The solar driven novelty device of claim 1, which further comprises a stationary disk disposed on said frame in a spaced relationship between said rotatable disk and said frame.

4. The solar driven novelty device of claim 3, wherein said rotatable disk is provided with a plurality of slits which permit viewing of said stationary disk as said rotatable disk is rotating.

5. The solar driven novelty device of claim 4, wherein said stationary disk has indicia thereon to be viewed through the slits of said rotatable disk as it is rotating.

6. A solar driven novelty device for mounting to a surface comprising:

a) a frame having a first side and a second side;

b) a solar panel attached to said frame and in an adjustable relationship thereto such that said solar panel can be adjusted in relation to said frame to receive incident light irrespective of the orientation of said frame;

c) a rotatable disk disposed on said frame;

d) a motor in operative connection with said solar panel and also in operative connection with said disk, wherein said motor causes said disk to rotate in response to electricity generated by said solar panel and transmitted to said motor; and e) means for attaching said frame to the surface, said means being adjustable to permit either said first side of said frame or said second side of said frame to be adjacent to the surface to which said frame is attached.

7. The solar driven novelty device of claim 6, wherein said attachment means comprises at least one rod, a portion of which extends out from said first side and said second side of said frame, and at least one suction cup which is removably disposed on either of said extending portions of said rod.

8. The solar driven novelty device of claim 7, which comprises four of said extending rods and four of said suction cups.

9. The solar driven novelty device of claim 6, wherein said solar panel is fixedly mounted to a rod disposed through eye hooks mounted on said frame so as to permit pivoting of said solar panel relative to said frame.

10. The solar driven novelty device of claim 6, wherein said disk contains indicia which can be viewed as said disk is rotating.

11. The solar driven novelty device of claim 10, wherein said motor comprises a gear to reduce the speed of rotation of said disk to permit viewing of said indicia.

12. The solar driven novelty device of claim 6, which further comprises a stationary disk disposed on said frame in a spaced relationship between said rotatable disk and said frame.

13. The solar driven novelty device of claim 12, wherein said rotatable disk is provided with a plurality of slits which permit viewing of said stationary disk as said rotatable disk is rotating.

14. The solar driven novelty device of claim 13, wherein said rotatable disk and said stationary disk are of different colors.

15. The solar driven novelty device of claim 13, wherein said stationary disk has indicia thereon to be viewed through the slits of said rotatable disk as it is rotating.

16. The solar driven novelty device of claim 6, wherein said surface comprises a window.

17. The solar driven novelty device of claim 16, wherein said attachment means are disposed to attach said frame to said window such that the second side of said frame is adjacent said window.

18. The solar driven novelty device of claim 16, wherein said window is the window of a car and said novelty device is disposed inside said car with said solar panel pivoted so as to face outside said window and receive incident light.

19. The solar driven novelty device of claim 16, wherein said attachment means are disposed such that said device is attached to said window such that said first side of said frame is adjacent said window.

20. The solar driven novelty device of claim 19, wherein said window comprises a house window and said novelty device is disposed outside said window such that said rotatable disk can be viewed from inside said house, and said solar panel pivoted away from said window to receive incident light.

* * * * *